US011211199B2

(12) United States Patent
Paz-Soldan et al.

(10) Patent No.: US 11,211,199 B2
(45) Date of Patent: Dec. 28, 2021

(54) SELF-PROPELLED SELF-REFERENCING VEHICLE MAGNET WINDING METHOD AND SYSTEM

(71) Applicant: GENERAL ATOMICS, San Diego, CA (US)

(72) Inventors: Carlos Paz-Soldan, San Diego, CA (US); Andrew Benson, Chico, CA (US); Paul Beharrell, San Diego, CA (US); Daniel Mullins, Temecula, CA (US)

(73) Assignee: GENERAL ATOMICS, San Diego, CA (US)

( * ) Notice: Subject to any disclaimer, the term of this patent is extended or adjusted under 35 U.S.C. 154(b) by 0 days.

(21) Appl. No.: 17/220,032

(22) Filed: Apr. 1, 2021

(65) Prior Publication Data

US 2021/0319950 A1 Oct. 14, 2021

Related U.S. Application Data

(60) Provisional application No. 63/007,676, filed on Apr. 9, 2020.

(51) Int. Cl.

| | |
|---|---|
| ***H01F 6/06*** | (2006.01) |
| ***H01F 41/082*** | (2016.01) |
| ***H01F 41/098*** | (2016.01) |
| ***H01F 27/30*** | (2006.01) |
| *B61B 13/12* | (2006.01) |

(52) U.S. Cl.

CPC ..... *H01F 41/082* (2016.01); *H01F 27/30* (2013.01); *H01F 41/098* (2016.01); *B61B 13/125* (2013.01)

(58) Field of Classification Search

CPC .... H01F 41/082; H01F 41/068; H01F 41/096; H01F 41/098; H01F 41/071; H01F 41/086; H01F 6/06; H01F 27/30

See application file for complete search history.

(56) References Cited

U.S. PATENT DOCUMENTS

| | | | | |
|---|---|---|---|---|
| 4,746,075 | A | 5/1988 | Hoxit | |
| 2011/0115595 | A1* | 5/2011 | Tseng | H01F 38/08 336/192 |

OTHER PUBLICATIONS

Parker et al.; "Serpentine Coil Technology for BNL Direct Wind Superconducting Magnets"; pp. 737-739; IEEE 2005.

Parker, et al.; "BNL Direct Wind Superconducting Magnets"; Submitted at the 22nd International Conference on Magnet Technology; Sep. 12-16, 2011; Published Nov. 2011 by Brookhaven National Laboratory; 6 pages.

(Continued)

*Primary Examiner* — Emmanuel M Marcelo

(74) *Attorney, Agent, or Firm* — Fitch, Even, Tabin & Flannery LLP

(57) ABSTRACT

An apparatus and method for winding electrical coils (electromagnets) is described. A self-propelled and self-referencing winding vehicle uses features on a winding bobbin to guide the direction and/or orientation of the vehicle, while laying electrical conductor material (e.g., high-temperature superconducting (HTS) tapes) as it traverses the bobbin. The vehicle may wind electrical coils with complex shapes. In some embodiments, the self-propelled, self-referencing (SPSR) vehicle may perform other magnet fabrication and assembly procedures.

35 Claims, 10 Drawing Sheets

(56) References Cited

OTHER PUBLICATIONS

Paz-Soldan; "Non-Planar Coil Winding Angle Optimization for Compatibility with Non-Insulated High-Temperature Superconducting Magnets"; Journal of Plasma Physics; vol. 86, p. 815860501; 2020.

Strykowsky, et al.; "Postmortem Cost and Schedule Analysis—Lessons Learned on NCSX"; Princeton Plasma Physics Laboratory; Mar. 2012.

International Search Report and Written Opinion of the International Searching Authority for PCT Application No. PCT/US2021/025436 dated Jul. 8, 2021.

On-Site Fabrication :Poloidal Field Coils; ITER; 2020; retrieved on Jun. 7, 2021; https://www.iter.org/construction/SiteFabricationPFcoils; 3 pages.

Wu et al; "Multipole Magnets for the HIAF Fragment Separator using the Canted-Cosine-Theta (CCT) Geometry"; Journal of Physics: Conference Series; 1401; 2020; 10 pages (9 pages plus cover page).

Yu et al; "Winding Techique for HT-7U Tokamak Magnet Coils"; IEEE Transactions on Applied Superconductivity, vol. 10, No. 1, Mar. 2000; pp. 632-635.

* cited by examiner

SELF-PROPELLED SELF-REFERENCING VEHICLE MAGNET WINDING METHOD AND SYSTEM

This application claims the benefit of U.S. Provisional Patent Application No. 63/007,676, filed Apr. 9, 2020, entitled "Self-Propelled Self-Referencing Vehicle Magnet Winding Method", which is incorporated by reference herein in its entirety.

BACKGROUND OF THE INVENTION

1. Field of the Invention

The present invention generally relates to the winding of electrical coils (electromagnets), and more specifically relates to the winding of electrical coils having complex shapes. Electrical coils with complex shapes can be found in superconducting magnet energy storage systems, particle accelerator systems, and magnetic fusion energy systems, among other examples.

2. Discussion of the Related Art

Electromagnets are usually planar in shape and wound using a turntable technique. In this technique, continuous electrical conductor material (e.g., such as wire or electrical conductor tape) is provided from a fixed point in space and wound onto a planar bobbin (e.g., onto a portion of the bobbin structure) by rotating the bobbin on a turntable.

The rotating bobbin includes a winding trough. The electrical conductor material is spooled from a stationary point and as the electrical conductor material is spooled along the winding path the trough receives the sequential layers of electrical conductor material in the winding trough as the bobbin is rotated, forming the coil.

However, this technique may not easily be applied (or at times may not be possible) if the shape of the magnet to be wound is complex (e.g., three-dimensional, uneven, unsymmetrical, etc.).

The "Direct Wind" technique developed by Brookhaven National Laboratory involves applying a malleable conductor onto a more complex turn-table capable of more degrees of freedom (Parker et al., *BNL Direct Wind Superconducting Magnets,* 22nd International Conference on Magnet Technology, Sep. 9-16, 2011). However, Direct Wind techniques may rely on a fixed application point and a turntable-like setup. As such, Direct Wind techniques may not apply a conductor (e.g., electrical conductor tape) to arbitrarily complex surfaces, and such techniques may require the application to be "orientable" (e.g., which is, the application must be able to be represented with a two-dimensional coordinate system, or on a plane). Furthermore, anisotropic conductors, such as high-temperature superconducting (HTS) tapes, may not be well suited to the Direct Wind technique, as the Direct Wind technique relies on a malleable isotropic conductor.

Therefore, there is a need for an improved way to wind electrical conductor material onto structures that may be more complex structures (e.g., where application may not be able to be represented with a two-dimensional coordinate system), though in other embodiments techniques described herein may also be implemented to wind simple structures.

Due to their intrinsically steady-state operation and low recirculating power, stellarators have a significant conceptual advantage over tokamaks in commercial applications. One potential application of this technology is the stellarator magnetically confined fusion energy concept. Early stellarators exhibited poor confinement, leading to their neglect until the concepts of quasi-symmetry and quasi-omnigeneity were shown to be valid means of controlling neoclassical energy losses. Implementing these concepts, however, mandates complex, high precision coil configurations that have, for example, stymied construction programs and led to unacceptably high assembly hours (e.g., over 100 hours).

Therefore, there is a need to resolve a central challenge for the stellarator: construction of complex coils. Resolving this difficulty improves the overall attractiveness of the stellarator. Other applications for complex magnet geometries also exist.

SUMMARY

An apparatus and method for winding electrical coils (electromagnets) is described. A self-propelled and self-referencing winding vehicle uses features on a winding bobbin to guide the direction and/or orientation of the vehicle, while laying electrical conductor material (e.g., high-temperature superconducting (HTS) tapes) as it traverses the bobbin. The vehicle may wind electrical coils with complex shapes. In some embodiments, the self-propelled, self-referencing (SPSR) vehicle may perform other magnet fabrication and assembly procedures.

An apparatus, system, and method for winding electrical conductor material are described. One or more embodiments of the apparatus, system, and method include a stationary bobbin including a continuous looped winding trough and a vehicle including a frame and being movably coupled to the stationary bobbin, the vehicle being configured to traverse the bobbin and, while traversing the bobbin, continuously dispense continuous electrical conductor material into the continuous looped winding trough, where a plurality of coils of the electrical conductor material are placed in the winding trough.

A method, apparatus, non-transitory computer readable medium, and system for winding electrical conductor material are described. One or more embodiments of the method, apparatus, non-transitory computer readable medium, and system include traversing of a stationary bobbin by a vehicle, wherein the bobbin includes a continuous looped winding trough configured to receive the electrical conductor material and dispensing the electrical conductor material continuously from the vehicle into the looped winding trough while the vehicle is traversing the stationary bobbin, where a plurality of coils of the electrical conductor material are placed in the winding trough.

A method, apparatus, non-transitory computer readable medium, and system for winding electrical conductor material are described. One or more embodiments of the method, apparatus, non-transitory computer readable medium, and system include manufacturing a bobbin including a continuous looped winding trough, supporting the bobbin above a fixed base in a stationary position, manufacturing a winding vehicle, wherein the vehicle includes a frame and is configured to continuously dispense continuous electrical conductor material, and movably coupling the vehicle to the bobbin such that the vehicle is configured to continuously dispense the electrical conductor material into the winding trough as the vehicle traverses the bobbin along the winding trough.

Figure 1:
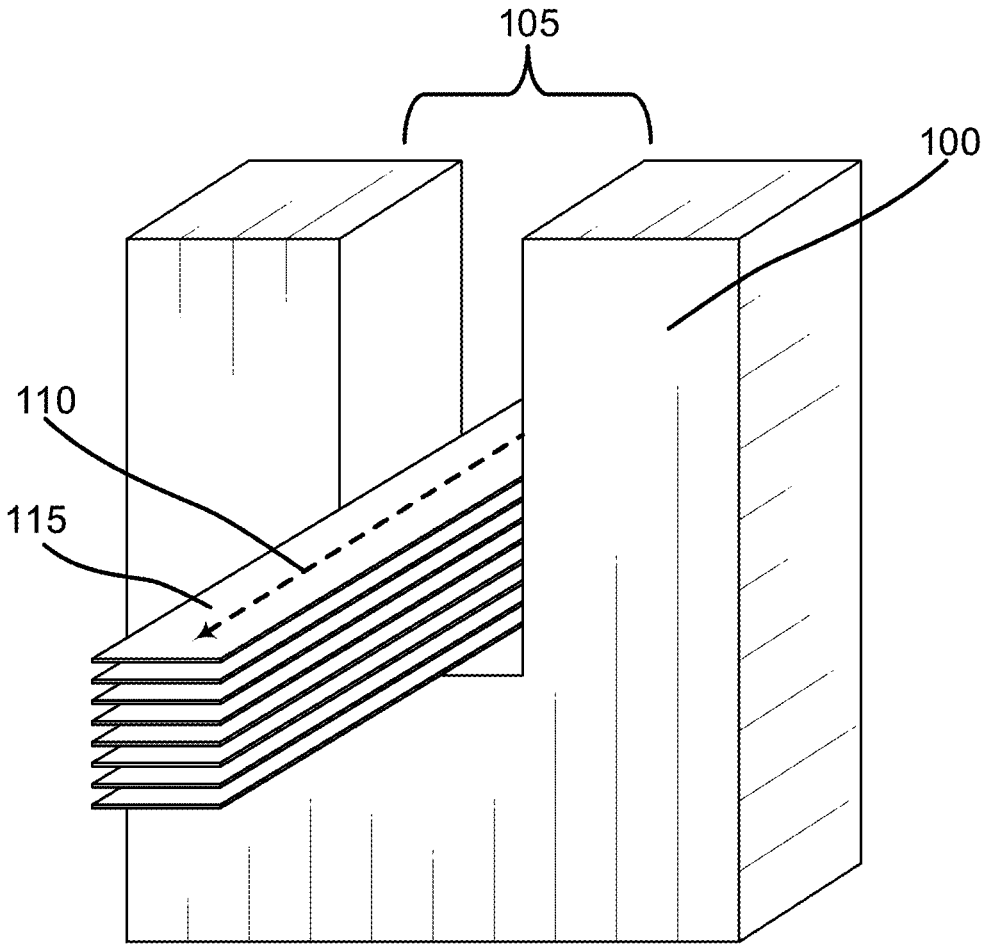
FIG. 1 shows an example of a portion of a bobbin structure for winding electrical conductor material according to aspects of the present disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

A method is described in the present document for fabricating non-planar coils, for example, using high-temperature superconductors (HTS). Embodiments described herein may materially improve the cost and schedule associated with fusion concepts utilizing non-planar coils (such as a stellarator). Further, embodiments described herein may serve as a technology enabler for high field magnet non-fusion applications. Techniques described herein may provide a simpler (e.g., less complex, less time consuming, etc.) and more cost-effective way to lay electrical conductor material on complex coil geometries.

For instance, some techniques for non-planar coils involve rotating a winding cable by manipulating an entire bobbin while electrical conductor material is slowly supplied from a fixed location. In the case of complex non-planar coils, a multi-axis winding table may be implemented, which may not be effective for conductors that are to be wound in compression. In addition, some geometries may be difficult (or not possible) using a winding table, as the resulting bobbin motion may cause the table and the bobbin to collide.

The techniques described herein are less sensitive to bobbin geometry (e.g., and may depend on the size of a winding vehicle relative to the bobbin). The winding vehicle may be small in comparison to the winding table. As a result, the embodiments described herein allow greater freedom of design, which is particularly important considering, for example, the use of HTS conductors in complex coil manufacture such as for a stellarator magnetic fusion energy concept. HTS conductors may take the form of a thin tape (e.g., electrical conductor tape) that bends easily perpendicular to the tape's surface but is strain intolerant in the tape's surface plane.

In some examples, HTS materials may be used in fusion energy applications (e.g., tokamaks). Quick, easy, and effective winding of stellarator coil geometries using HTS tapes may be advantageous. In accordance with the embodiments described herein, the complexity of coil geometry may be overcome by having a bobbin with a winding trough and with integral guides (e.g., rails or tracks) that allow a self-propelled and self-referencing vehicle to traverse the coil trajectory while laying the electrical conductor material.

Techniques described herein may be applied to complex non-planar coils made with HTS tape electrical conductor material, which has strain limits, but the present description should not be understood to be limited to such configurations.

The techniques described herein may allow one to extend the non-insulating HTS (NI-HTS) magnet to complex non-planar geometries by: 1) deploying a winding angle optimization technique and using 3D printing to create bobbins with continuous tracks (e.g., winding tracks) at an optimized angle, 2) deploying a self-propelled, self-referencing (SPSR) winding vehicle (e.g., which, in some cases, may be referred to as a car), to wind the bare HTS tape as a double-pancake onto the bobbin, and 3) using conductive cooling to address cryogenic requirements of an integrated magnet.

The novel, generic, scalable, and parallelizable embodiments described herein provide simplification and consequent cost reduction (e.g., for fusion concept benefiting from non-planar coils, with an example application including a stellarator). The embodiments described herein enable device simplification, leading to system cost reduction. Beyond the simplification and cost reduction, use of HTS conductors allows access to higher magnetic fields than conventional superconductors, opening a technically feasible path to increasing the magnetic field achievable in concepts like the stellarator.

In one embodiment, the method will target the fabrication and demonstration of a medium-bore (~50 cm) HTS stellarator coil operating at 500 kiloamp-turns (kAt) coil current at 20K as its central goal, estimated to reach approximately ~7.5 Tesla (T) at the coil face and ~1 T on-axis. The methods are scalable to higher fields and larger bores.

The present description provides a simplified method to manufacture non-planar coils with the NI-HTS method. The innovations of the winding angle optimization, vehicle, and integrated assembly provide a unique and scalable path towards fabricating large-bore, high-field non-planar magnets capable of operating at 20 T and 20 K (FOA Sec. I.D.1.iv), with the added benefit of parallelizability in manufacturing. For instance, a stellarator construction experience may identify geometry and accuracy demands as key cost drivers that ultimately lead to fatal cost over-runs. See R. Strykowsky et al., Postmortem Cost and Schedule Analysis—Lessons Learned On NCSX, PPPL Report 4742 (2012) https://www.osti.gov/servlets/purl/1074357, incorporated herein by reference. The combination of 3D printed bobbins (that define the geometry and accuracy) together with the vehicle method (that enables the winding) has an impact on both of these cost drivers.

FIG. 1 shows an example of a bobbin structure for winding electrical conductor material 115 according to aspects of the present disclosure. The example shown includes portion of the bobbin structure 100, winding trough 105, winding path 110, and electrical conductor material 115.

A portion of the bobbin structure 100 is shown that includes a winding trough 105. The trough receives the sequential layers of electrical conductor material 115 in the winding trough 105, forming the coil.

Figure 2:
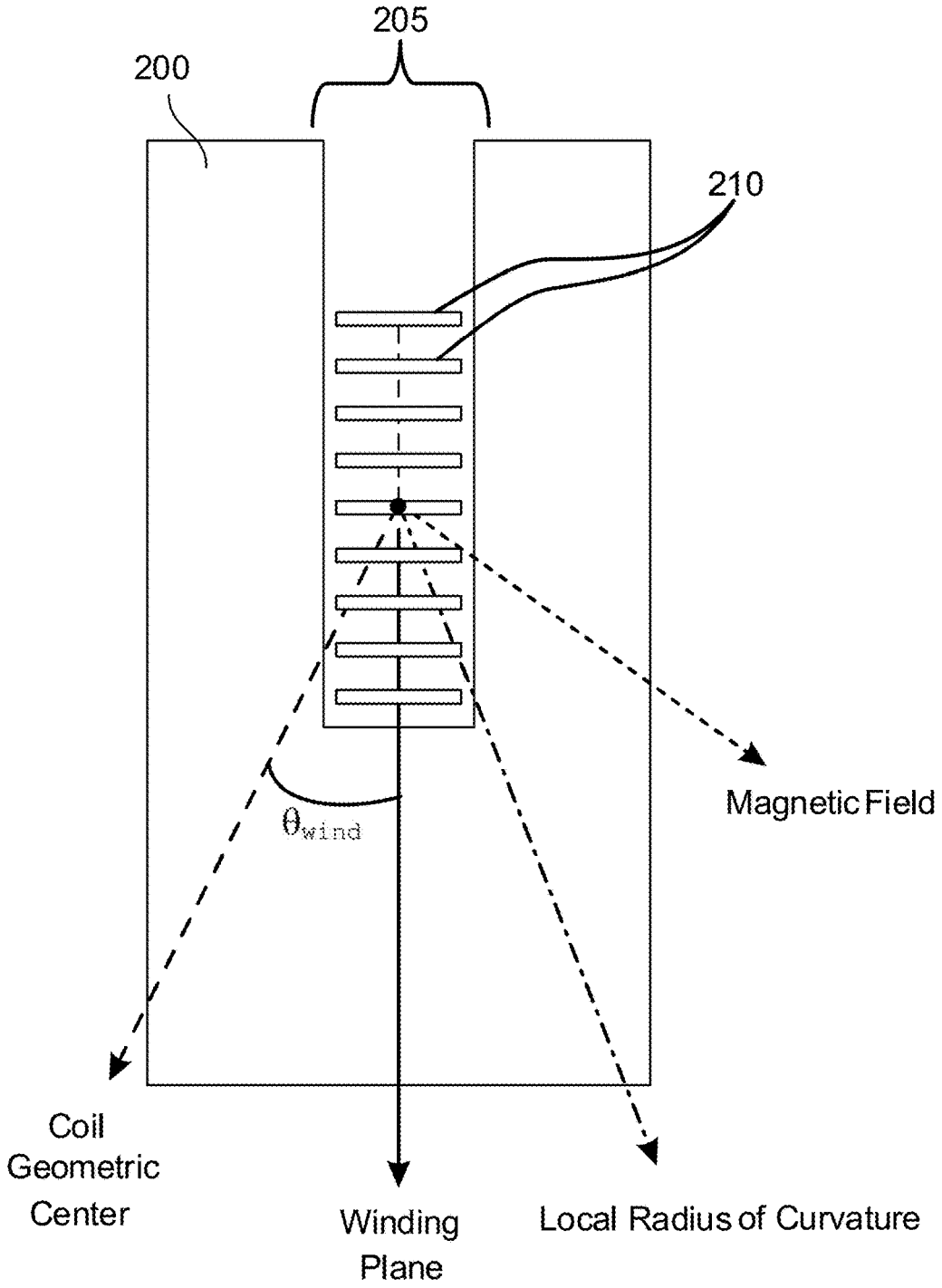
FIG. 2 shows an example of a winding electrical conductor material force diagram according to aspects of the present disclosure.

FIG. 2 shows an example of a winding electrical conductor material 210 force diagram according to aspects of the present disclosure. The example shown includes portion of the bobbin structure 200, winding trough 205, and electrical conductor material 210. Portion of the bobbin structure 200 is an example of, or includes aspects of, the corresponding element described with reference to FIG. 1. Winding trough 205 is an example of, or includes aspects of, the corresponding element described with reference to FIG. 1. Electrical conductor material 210 is an example of, or includes aspects of, the corresponding element described with reference to FIGS. 1, 6, and 8.

The present description describes a winding angle optimization that, in some cases, may be tailored to non-planar NI-HTS magnets. This work is described in detail in C. Paz-Soldan, Non-Planar Coil Winding Angle Optimization for Compatibility with Non-Insulated High-Temperature Superconducting Magnets, Journal of Plasma Physics (2021) http://arxiv.org/abs/2003.02154, incorporated herein by reference. As the current density in NI-HTS magnets is high, the current path may be filamentary, and the winding angle is an unconstrained degree of freedom that can be exploited. HTS performance can be degraded by unwanted strains within the tape, as well as by perpendicular magnetic fields. The winding angle optimization essentially maximizes the HTS tape performance in terms of its current capacity against these constraints. FIG. 2 shows the winding angle degree of freedom compared to the magnetic field and curvature.

Figure 3:
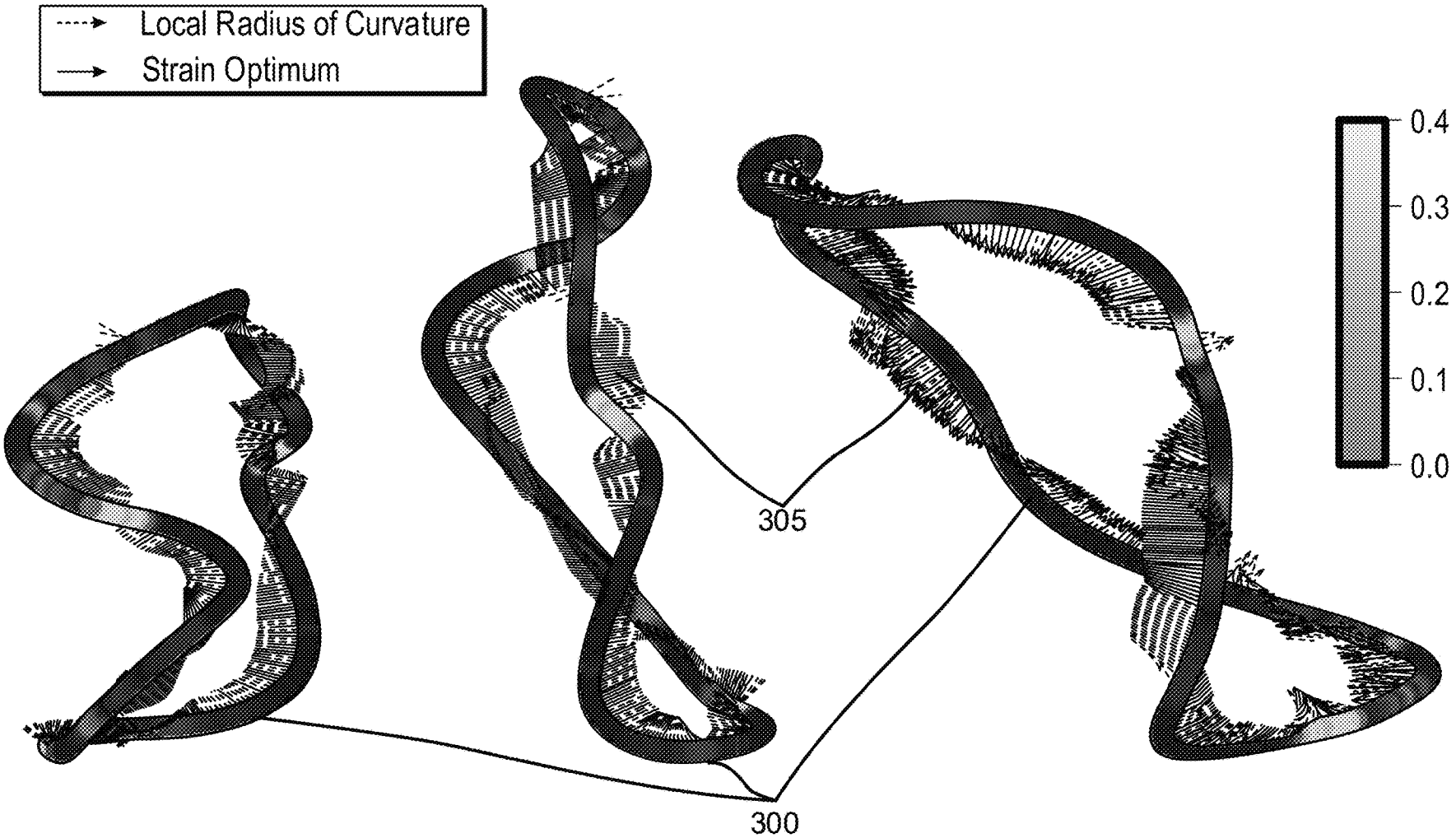
FIG. 3 shows an example of an electromagnetic coil according to aspects of the present disclosure.

FIG. 3 shows an example of an electromagnetic coil 300 according to aspects of the present disclosure. In one embodiment, coil 300 includes local radius of curvature 305.

FIG. 3 shows an example with the resultant optimized winding angles and strains arising in an example non-planar coil 300 calculated. The same non-planar coil 300 is shown oriented in three different orientations for clarity. The strain is indicated by the graphic value of the coil 300 (i.e. the light value on the coil 300 indicates larger strain). Arrows indicating direction and degree of local radius of curvature 305 are shown. Light-valued arrows indicate optimum strain at that location. Peak strain occurs between bends in the non-planar coil 300, with both bending and torsion predicted.

As shown in FIGS. 2 and 3, winding angle ($\theta_{wind}$) optimization mitigates electrical conductor material degradation (e.g., HTS tape degradation) arising from strains due to bending the electrical conductor material the wrong way and electrical conductor material twisting (torsion), as well as the impact of perpendicular fields.

Figure 4:
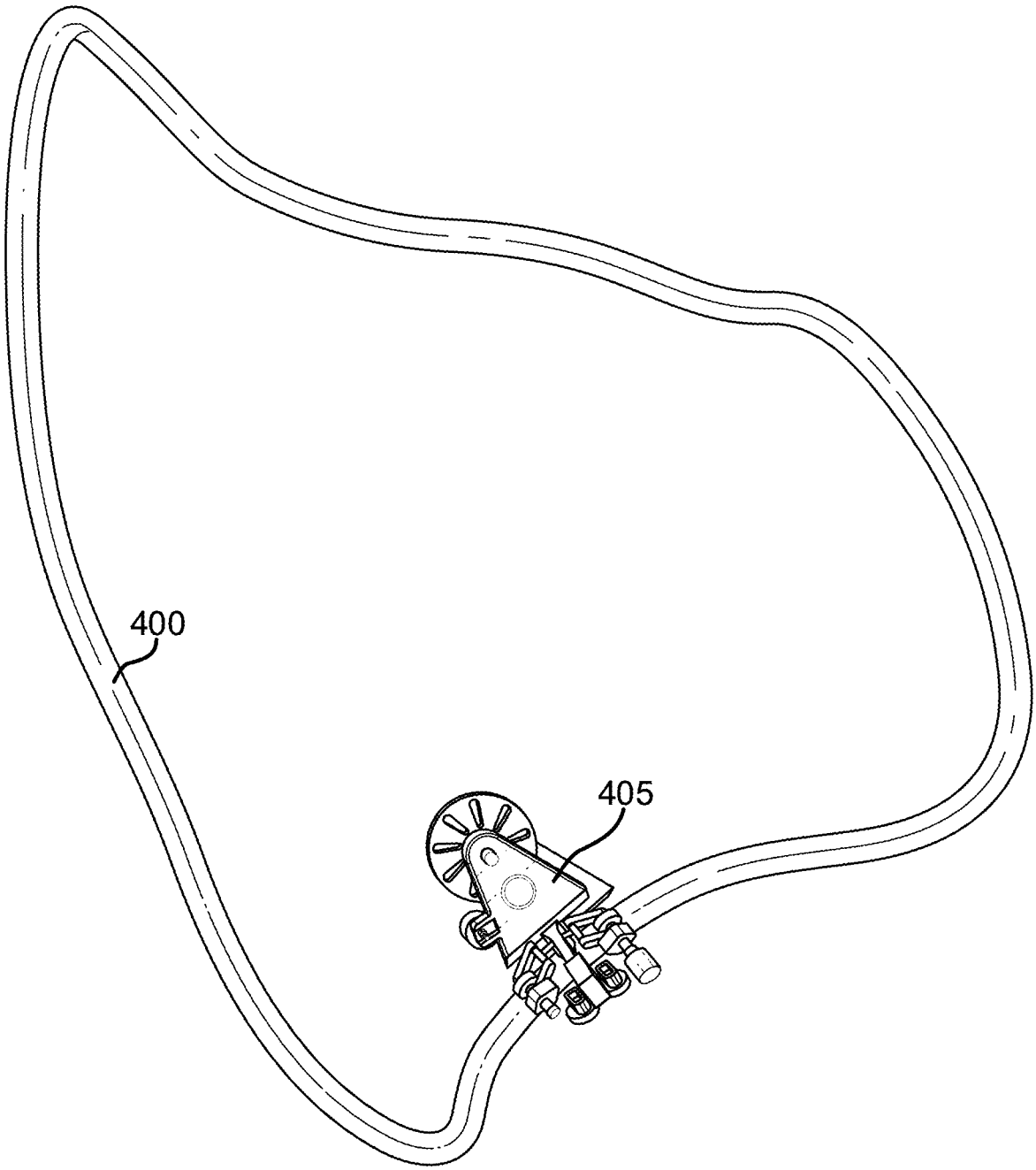
FIGS. 4 through 7 show examples of a magnet winding system according to aspects of the present disclosure.

FIG. 4 shows an example of a magnet winding system according to aspects of the present disclosure. The example shown includes bobbin 400 and vehicle 405. Bobbin 400 is an example of, or includes aspects of, the corresponding element described with reference to FIGS. 5-7. Vehicle 405 is an example of, or includes aspects of, the corresponding element described with reference to FIGS. 5-7.

The present description provides a simplified method to manufacture non-planar coils with the NI-HTS method. The innovations of the winding angle optimization, vehicle 405, and integrated assembly provide a unique and scalable path towards fabricating large-bore, high-field non-planar magnets capable of operating at 20 T and 20 K (FOA Sec. I.D.1.iv), with the added benefit of parallelizability in manufacturing. For instance, a stellarator construction experience may identify geometry and accuracy demands as key cost drivers that ultimately lead to fatal cost over-runs. The combination of 3D printed bobbins 400 (that defines the geometry and accuracy) together with the vehicle 405 method (that enables the winding) has an impact on both of these cost drivers.

In FIG. 4, an exemplary magnet winding system including a self-propelled self-winding (SPSR) winding vehicle 405 (car) is shown. Shown are the winding vehicle 405 (e.g., SPSR winding vehicle 405) and the bobbin 400. The SPSR vehicle 405 is a device that uses an on-board drive motor to traverse a bobbin 400, laying electrical conductor material (e.g., electrical conductor tape) as it traverses. Self-referencing of the vehicle 405 (i.e. automatic orienting of the vehicle 405 with respect to the bobbin 400 such that the electrical conductor material is laid on the bobbin 400 in a winding trough) may be provided by built-in guide rails (guide tracks) of the bobbin 400. In some examples, the rails/tracks may be created on the bobbin 400 at the time the bobbin 400 is manufactured by additive (3D) printing or may be machined into the bobbin 400 after printing.

Figure 5:
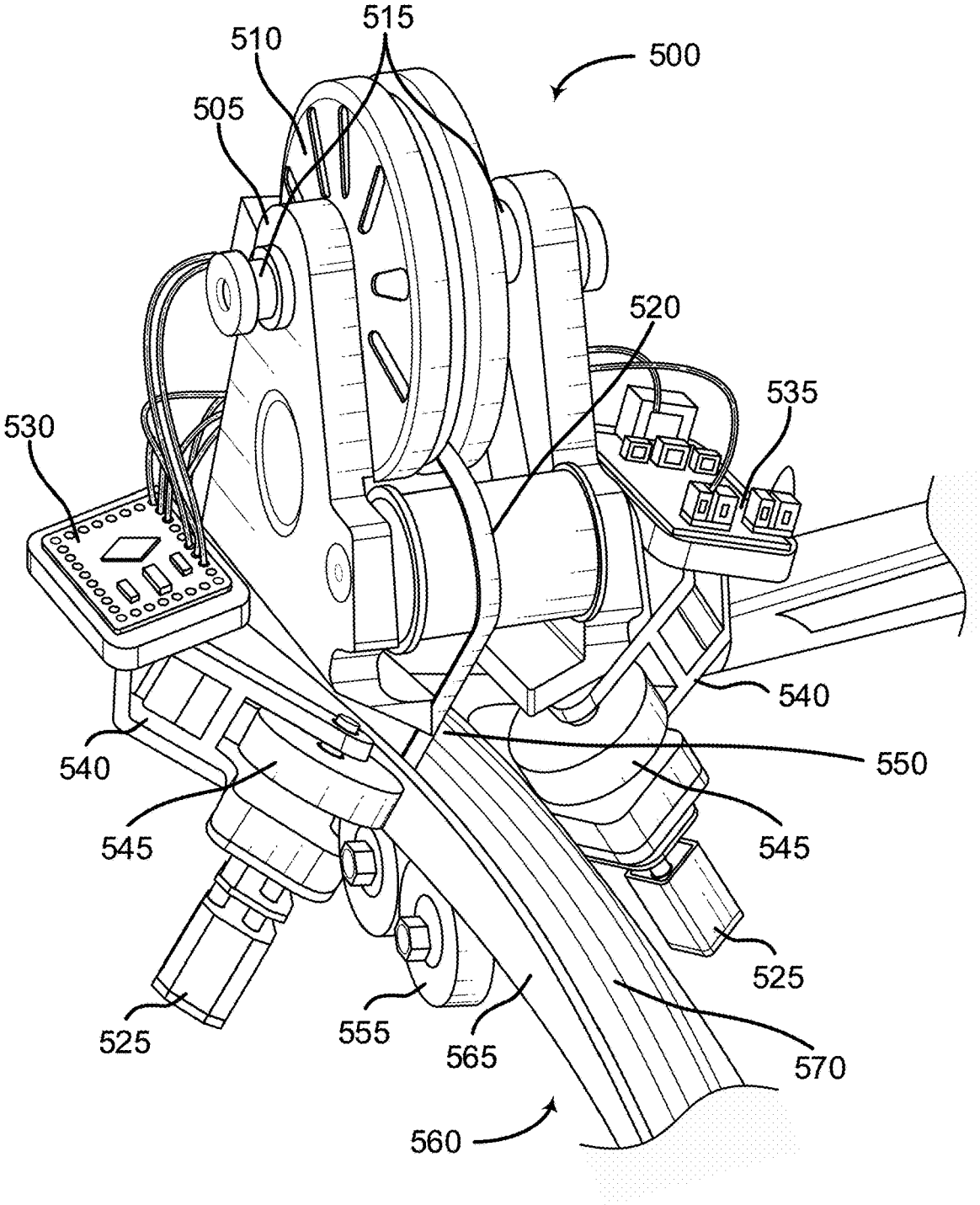
Figure 6:
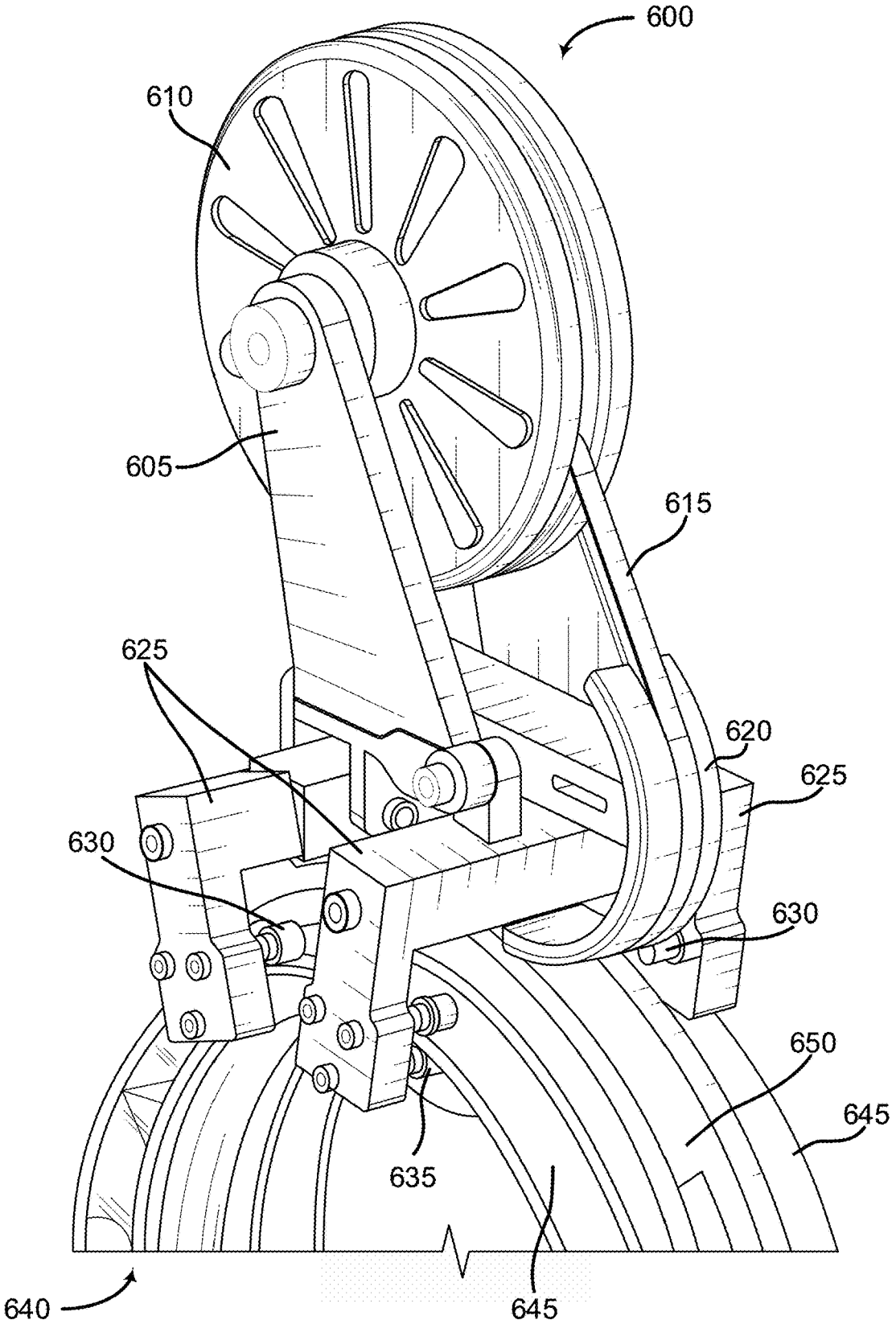
Figure 7:
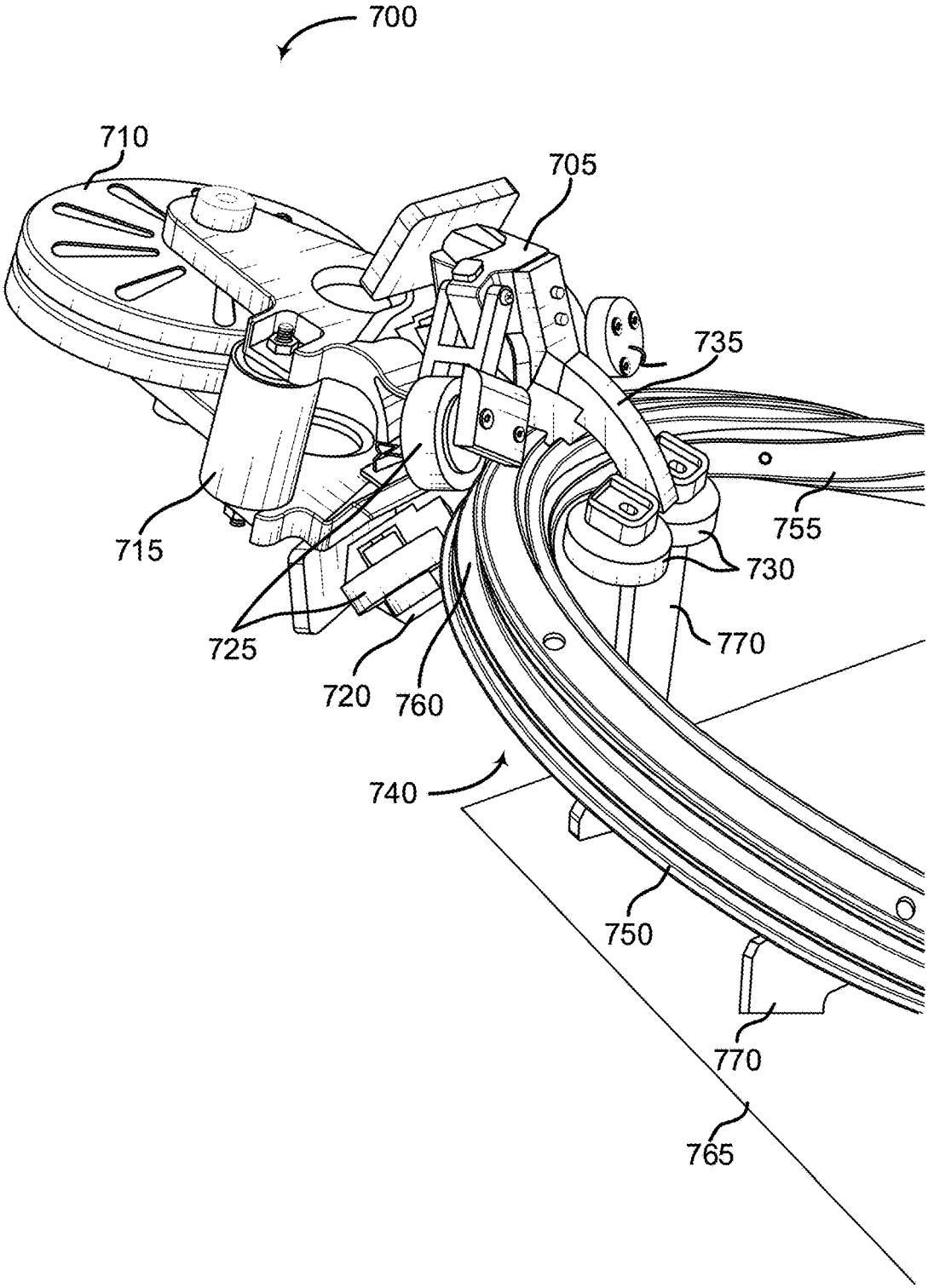

The vehicle 405 includes at least one self-referencing member configured to engage with the bobbin 400 such that the vehicle 405 is self-referencing during winding (e.g., as further described herein, for example, with reference to FIGS. 5-7). In some embodiments the self-referencing members are wheels coupled to the vehicle 405 such that each wheel rides along a track or rail, with the result of maintaining the proper orientation of the vehicle 405 to the track/rail. In some embodiments, a plurality of tracks/rails are utilized. In other embodiments the bobbin 400 has a single track/rail. In other embodiments the bobbin 400 may have two, three, four or more than four tracks/rails. While wheels may be indicated, any suitable self-referencing member may be used that allows the vehicle 405 to be propelled along the track while maintaining a specified orientation of the vehicle 405 with relation to the winding trough (or troughs). A plurality of self-referencing members may ride each track/rail. This apparatus and method may be applied to lay electrical conductor material (e.g., HTS tape) onto complex bobbin 400 shapes (i.e., to form non-planar coils), but can also lay any ductile conductor material onto any bobbin 400 shape.

According to some embodiments, bobbin 400 includes a continuous looped winding trough. In some examples, the bobbin 400 includes copper, steel, aluminum, or any mixture thereof. In some examples, the bobbin 400 is formed by additive manufacturing. In some examples, the bobbin 400 includes a shape that is formed at least in part by additive manufacturing. In some examples, the bobbin 400 includes a shape formed at least in part by machining.

According to some embodiments, vehicle 405 includes a frame and is movably coupled to the stationary bobbin 400, the vehicle 405 being configured to traverse the bobbin 400 and, while traversing the bobbin 400, continuously dispense continuous electrical conductor material into the continuous looped winding trough, where a plurality of coils of the electrical conductor material are placed in the winding trough. In some examples, the system is configured to automatically orient the vehicle 405 with respect to the continuous looped winding trough while the vehicle 405 traverses the bobbin 400. In some examples, the configuration to automatically orient the vehicle 405 includes a continuous track in the bobbin 400 and at least one self-referencing member of the vehicle 405 engaged with the continuous track.

In some examples, the vehicle 405 further includes at least one articulating structure engaged with the bobbin 400 to facilitate self-referencing of the vehicle 405. In some examples, the vehicle 405 is configured for self-propelling along the trough. In some examples, the self-propelling includes the vehicle 405 using a drive motor coupled to the frame to rotate a set of wheels of the vehicle 405, where operation of the drive motor rolls the vehicle 405 along the winding trough. In some examples, the vehicle 405 is configured to store undispensed electrical conductor material and dispense the electrical conductor material. In some examples, the electrical conductor is stored on and dispensed by a rotating spool rotatably coupled to the vehicle 405. In some examples, the vehicle 405 is configured to receive the electrical conductor material from an off-vehicle location prior to dispensing the electrical conductor material. In some examples, the vehicle 405 is configured to traverse the bobbin 400 by being manually propelled along the winding trough.

In some examples, the final assembly of the system includes usage of electrical solder material. In some examples, the electrical conductor material is high-temperature superconducting tape material or high-temperature superconducting wire material. In some examples, the electrical conductor material is low-temperature superconducting wire material. In some examples, the electrical conductor material is an assembly including a set of different electrical conductor materials. In some examples, one of the different electrical conductor materials is an electrically insulating material. In some examples, the winding trough is a double pancake winding trough.

According to some embodiments, vehicle 405 traverses a stationary bobbin 400 by a vehicle 405, where the bobbin 400 includes a continuous looped winding trough configured to receive the electrical conductor material. In some examples, vehicle 405 dispenses the electrical conductor material continuously from the vehicle 405 into the looped winding trough while the vehicle 405 is traversing the stationary bobbin 400, where a set of coils of the electrical conductor material are placed in the winding trough.

In some examples, vehicle 405 engages with the bobbin 400, by the vehicle 405, to automatically orient the vehicle 405 with respect to the looped winding trough while the vehicle 405 is traversing the stationary bobbin 400. In some examples, the vehicle 405 engaging with the bobbin 400 includes a continuous track in the bobbin 400 and a self-referencing member of the vehicle 405 engaged with the continuous track. In some examples, the vehicle 405 includes at least one articulating structure engaged with the bobbin 400 to facilitate self-referencing of the vehicle 405. In some examples, vehicle 405 forms an electromagnetic coil with the set of coils as a result of the electromagnetic conductor material placed in the trough. In some examples, the vehicle 405 traversing the bobbin 400 includes the vehicle 405 being self-propelled along the bobbin 400. In some examples, the self-propelling of the vehicle 405 includes a drive motor of the vehicle 405 operating a set of wheels of the vehicle 405, where operation of the drive motor rolls the vehicle 405 along the trough.

In some examples, the vehicle 405 is configured to store undispensed electrical conductor material. In some examples, the undispensed electrical conductor material is stored on a rotating spool movably coupled to the vehicle 405. In some examples, the electrical conductor material is received from an off-vehicle 405 location prior to the dispensing. In some examples, the traversing of the bobbin 400 by the vehicle 405 includes the vehicle 405 being manually propelled along the bobbin 400. In some examples, the electrical conductor material is high-temperature superconducting tape material or high-temperature superconducting wire material. In some examples, the electrical conductor material is low-temperature superconducting wire material. In some examples, the electrical conductor material is an assembly including a set of different electrical conductor materials. In some examples, one of the different electrical conductor materials is an electrically insulating material. In some examples, the winding trough is a double pancake winding trough.

FIG. 5 shows an example of a magnet winding system according to aspects of the present disclosure. The example shown includes vehicle 500 and bobbin 560.

In FIG. 5, an embodiment of a magnet winding system is shown. Shown are a frame 505, a plurality of Hall effect sensors 515, a spool 510, electrical conductor material, an electrical conductor material guide 520, a drive motor 525, a motor controller 530, a motor driver 535, a plurality of articulated legs, a trough guide 550, fixed wheels 555, drive wheels 545, a bobbin 560, a double-pancake winding trough 570, and a bobbin 560 track 565. In the embodiment of FIG. 5, utilizing the 3D printed bobbin 560, the vehicle 500 (car) uses on-board drive motors 525 and electronics (e.g. the motor controller 530 and motor driver 535) to traverse the bobbin 560 along the pre-defined track 565. As the vehicle 500 traverses the bobbin 560, the vehicle 500 gradually unspools the electrical conductor material (in this example HTS tape) onto one trough of the double-pancake winding trough 570, gradually winding half of the double pancake coil. Continual tension is provided by hall-effect sensors on the spool 510, which directly actuates the drive motor 525 torque in a feedback loop controlled using the on-board electronics.

In one embodiment, the vehicle 500 includes a battery and is battery operated, enabling unobstructed traverses of the entire continuous bobbin 560 trough. In at least some embodiments, the complexity of the 3D printed bobbin 560 is entirely transferred to the non-planar coil, as the vehicle 500 works locally, without noticing the coil complexity. Soldered joints using electrical solder material are utilized to extend the length of the electrical conductor material, enabling the hundreds of turns (windings) required to access a very high field. Note that a large number of turns yields a very high inductance magnet, a property that is compatible with direct current (DC) or quasi-DC concepts like the stellarator. While a double pancake winding trough is shown, it will be understood that in other embodiments the bobbin 560 has a single winding trough.

Vehicle 500 is an example of, or includes aspects of, the corresponding element described with reference to FIGS. 4, 6, and 7. In one embodiment, vehicle 500 includes frame 505, spool 510, Hall effect sensors 515, electrical conductor material guide 520, motor 525, motor controller 530, motor driver 535, articulating structure 540, drive wheel 545, trough guide 550, and fixed wheel 555.

Frame 505 is an example of, or includes aspects of, the corresponding element described with reference to FIGS. 6 and 7. Spool 510 is an example of, or includes aspects of, the corresponding element described with reference to FIGS. 6 and 7. Electrical conductor material guide 520 is an example of, or includes aspects of, the corresponding element described with reference to FIGS. 6 and 7. Articulating structure 540 is an example of, or includes aspects of, the corresponding element described with reference to FIGS. 6 and 7. Drive wheel 545 is an example of, or includes aspects of, the corresponding element described with reference to FIGS. 6 and 7. Fixed wheel 555 is an example of, or includes aspects of, the corresponding element described with reference to FIGS. 6 and 7.

Bobbin 560 is an example of, or includes aspects of, the corresponding element described with reference to FIGS. 4, 6, and 7. In one embodiment, bobbin 560 includes track 565 and double-pancake winding trough 570. Track 565 is an example of, or includes aspects of, the corresponding element described with reference to FIGS. 6 and 7. Double-pancake winding trough 570 is an example of, or includes aspects of, the corresponding element described with reference to FIGS. 6 and 7.

FIG. 6 shows an example of a magnet winding system according to aspects of the present disclosure. The example shown includes vehicle 600 and bobbin 640.

In FIG. 6, an embodiment of a magnet winding system is shown. Shown are a winding vehicle 600, a bobbin 640, a plurality of tracks 645, a double-pancake winding trough 650, a frame 605, a plurality of articulating legs, a plurality of wheels, a spool 610, an electrical conductor material guide 620, and electrical conductor material 615. In the embodiment of FIG. 6, as with the embodiment of FIG. 5 the electrical conductor material 615 is spooled on the spool 610 that is rotatably coupled to the frame 605 via a pin. As the vehicle 600 is moved along the bobbin 640, electrical conductor material 615 is automatically laid in the trough. A plurality of wheels ride on the tracks 645, resulting in self-referencing of the vehicle 600 with respect to the winding trough. In this embodiment, the frame 605 includes articulating legs coupled to the wheels. Each articulating leg is rotatable about a leg axis that is generally perpendicular to the trough direction. In the embodiment of FIG. 6, the winding vehicle 600 may be propelled by hand, although it will be understood that motor components may be added to propel the vehicle 600.

Vehicle 600 is an example of, or includes aspects of, the corresponding element described with reference to FIGS. 4, 5, and 7. In one embodiment, vehicle 600 includes frame 605, spool 610, electrical conductor material 615, electrical conductor material guide 620, articulating structure 625, drive wheel 630, and fixed wheel 635.

Frame 605 is an example of, or includes aspects of, the corresponding element described with reference to FIGS. 5 and 7. Spool 610 is an example of, or includes aspects of, the corresponding element described with reference to FIGS. 5 and 7. Electrical conductor material 615 is an example of, or includes aspects of, the corresponding element described with reference to FIGS. 1, 2, and 8. Electrical conductor material guide 620 is an example of, or includes aspects of, the corresponding element described with reference to FIGS. 5 and 7. Articulating structure 625 is an example of, or includes aspects of, the corresponding element described with reference to FIGS. 5 and 7. Drive wheel 630 is an example of, or includes aspects of, the corresponding element described with reference to FIGS. 5 and 7. Fixed wheel 635 is an example of, or includes aspects of, the corresponding element described with reference to FIGS. 5 and 7.

Bobbin 640 is an example of, or includes aspects of, the corresponding element described with reference to FIGS. 4, 5, and 7. In one embodiment, bobbin 640 includes track 645 and double-pancake winding trough 650. Track 645 is an example of, or includes aspects of, the corresponding element described with reference to FIGS. 5 and 7. Double-pancake winding trough 650 is an example of, or includes aspects of, the corresponding element described with reference to FIGS. 5 and 7.

FIG. 7 shows an example of a magnet winding system according to aspects of the present disclosure. The example shown includes vehicle 700, bobbin 740, fixed base 765, and bobbin support 770.

In FIG. 7, a third embodiment of a magnet winding system is shown. Shown are a winding vehicle 700, a bobbin 740, a plurality of upper tracks 750, a lower track 755, a winding trough, a plurality of fixed wheels 730 (e.g., lower wheels), a frame 705, a spool 710, an electrical conductor material guide 715, a lower extension 735, and a plurality of articulating legs (e.g., articulating structures 720). In the embodiment of FIG. 7, the articulating legs are pivotable at an axis that is at an angle to the winding direction. The lower extension 735 of the frame 705 extends downward past the side of the bobbin 740. Two wheels in sequence are rotatably coupled to the lower extension 735. Each wheel is engaged with and rides in the lower track 755. This adds to the stability of the vehicle 700 as it traverses the bobbin 740. The stationary bobbin 740 is supported on the fixed base 765 by bobbin supports 770 extending from the bobbin 740 to the base below. The bobbin supports 770 are spaced and attached to the bobbin 740 such that the bobbin supports 770 support the bobbin 740 in the correct position while allowing for the vehicle 700 to pass the support locations without interference with the winding operation.

Referring to FIGS. 4-7, some coil winding techniques for non-planar coils involve rotating a winding cable by manipulating an entire bobbin 740 while electrical conductor material is slowly supplied from a fixed location. In the case of complex non-planar coils, a multi-axis winding table may be required, which may not be effective for electrical conductor material that is to be wound in compression. In addition, some geometries are difficult (or not possible) using a winding table, as the required bobbin 740 motion may cause the table and the bobbin 740 to collide. For example, an application where the electrical conductor material twists from the outer to the inner diameter of the bobbin 740 and around to the outer diameter again cannot be wound from a fixed point in space without a collision.

The proposed SPSR winding method is less sensitive to bobbin 740 geometry. The vehicle 700 is generally small in comparison to a winding table, though the relative size of the bobbin 740 and vehicle 700 can vary based on details of the specific implementation. As a result, the proposed system and method allows greater freedom of design. One application of the SPSR vehicle 700 is in the use of high-temperature superconductor (HTS). This media is anisotropic (appearing as a tape form factor), and is subject to strain limits on its bending. HTS electrical conductor material may allow higher magnetic field and/or higher temperature operation, with advantages to many systems such as superconducting magnetic energy storage, particle accelerators, and magnetic fusion energy systems such as the stellarator. HTS conductors may take the form of a thin tape that bends easily perpendicular to the tape's surface but is strain intolerant in the tape's surface plane. Utilizing optimization techniques published in the peer-review literature, for a given non-planar coil geometry this strain can be mitigated by using a complex winding angle built into a bobbin 740 continuous track 745 (e.g., winding track 745).

The SPSR vehicle 700 technique may be applied to deliver electrical conductor material (e.g., HTS tape) at any winding angle by using a pre-defined complex bobbin 740 track 745 geometry. Additive manufacturing may be used to manufacture the complex bobbin 740, but other techniques can also be used. Embodiments of the system may include the SPSR vehicle 700 being propelled by an onboard drive system (though power may be provided externally from a power cable) and that there is no external referencing, with the direction of the SPSR vehicle 700 given by track 745 or rail features integral to the bobbin 740. The vehicle 700 described herein may use an onboard drive system to traverse a bobbin 740, laying electrical conductor material as it traverses. Self-referencing of the SPSR vehicle 700 is provided by built-in guide rails or track 745 that are created on the bobbin 740. The bobbin 740 tracks 745/rails can be created in one embodiment by additive manufacturing or in another embodiment by complex machining.

The vehicle 700/bobbin 740 system and method may be applied to lay electrical conductor material (e.g., HTS tape) onto complex bobbin 740 shapes, but the same method can also in-principle lay any ductile conductor onto any bobbin 740 shape. In one embodiment, the SPSR vehicle 700 may contain articulating structures 720 (e.g., articulating legs) to assist in traversing the bobbin 740, facilitating referencing to the tracks 745/rails. These articulating members allow a fixed point of reference at the point the electrical conductor material is inserted into the winding trough, while allowing more overall vehicle 700 stability and force/torque reaction.

Vehicle 700 is an example of, or includes aspects of, the corresponding element described with reference to FIGS. 4-6. In one embodiment, vehicle 700 includes frame 705, spool 710, electrical conductor material guide 715, articulating structure 720, drive wheels 725 (e.g., upper wheels), fixed wheel 730 (e.g., lower wheels), and lower extension 735.

Frame 705 is an example of, or includes aspects of, the corresponding element described with reference to FIGS. 5 and 6. Spool 710 is an example of, or includes aspects of, the corresponding element described with reference to FIGS. 5 and 6. Electrical conductor material guide 715 is an example of, or includes aspects of, the corresponding element described with reference to FIGS. 5 and 6. Articulating structure 720 is an example of, or includes aspects of, the corresponding element described with reference to FIGS. 5 and 6. Drive wheel 725 is an example of, or includes aspects of, the corresponding element described with reference to FIGS. 5 and 6. Fixed wheel 730 is an example of, or includes aspects of, the corresponding element described with reference to FIGS. 5 and 6.

Bobbin 740 is an example of, or includes aspects of, the corresponding element described with reference to FIGS. 4-6. In one embodiment, bobbin 740 includes track 745 and winding trough 760. Track 745 is an example of, or includes aspects of, the corresponding element described with reference to FIGS. 5 and 6. In one embodiment, track 745 includes upper track 750 and lower track 755. In some examples, winding trough 760 is an example of, or includes aspects of, the corresponding element described with reference to FIGS. 5 and 6.

Figure 8:
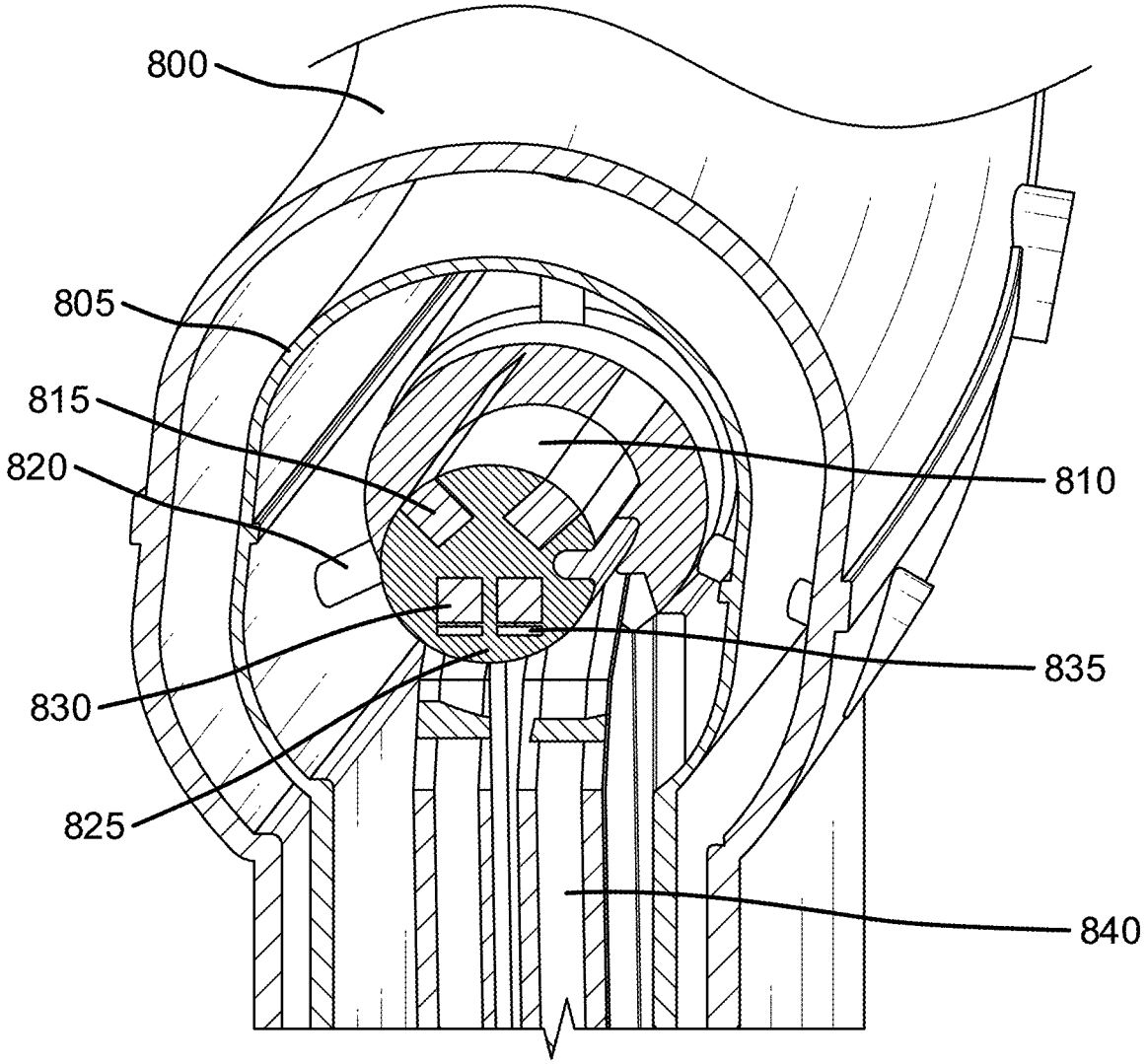
FIG. 8 shows an example of an integrated magnet assembly according to aspects of the present disclosure.

FIG. 8 shows an example of an integrated magnet assembly according to aspects of the present disclosure. In one embodiment, vacuum vessel 800 includes radiation shield 805, clamp 810, thermal paths 815, structural member 820, structural mating piece 825, tape pancake 830, conforming layer 835, and electrical conductor material 840. Electrical conductor material 840 is an example of, or includes aspects of, the corresponding element described with reference to FIGS. 1, 2, and 6.

In FIG. 8, an Integrated Magnet Assembly is shown. The wound non-planar coil may be integrated into a full magnet assembly, including cryogenics. One embodiment of a design for an integrated full magnet assembly is shown in FIG. 8. The exemplary design may include a cryogen-free magnet with copper thermal paths 815 integrated into the 3D printed bobbin 100 for conductive cooling. The bobbin 100 is 3D printed in steel with mechanical support and utilizes structural rods (e.g. to react any Lorentz forces to a vacuum vessel 800). A mating piece to the original bobbin also supports the main HTS double pancake against internal Lorentz forces. HTS current leads may have low current per turn. The described innovations of the winding angle optimization and the self-propelled and self-referencing winding vehicle, together with the advanced additive manufacturing of the bobbin and conductively-cooled cryogenic solutions, provide simplification and cost reduction for non-planar magnets operated at high-field. In one embodiment, a NI-HTS non-planar magnet capable of 500 kAt of coil current at 20 K temperature, with a ~50 cm warm bore, is made in accordance with the descriptions herein.

Figure 9:
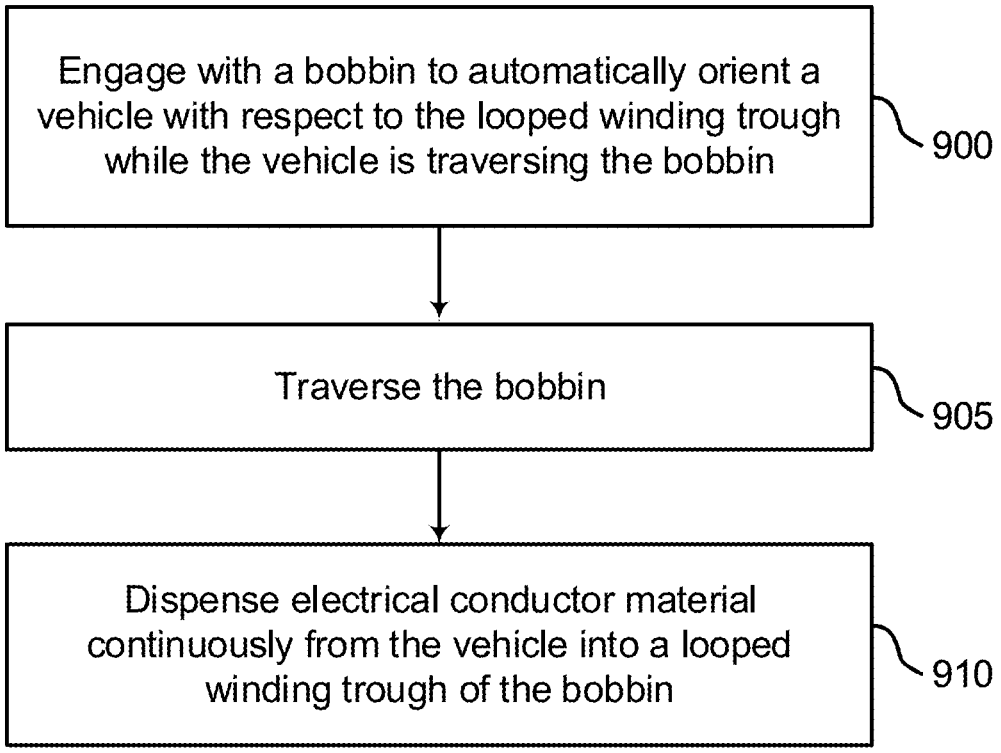
FIG. 9 shows an example of a process for winding electrical conductor material according to aspects of the present disclosure.

FIG. 9 shows an example of a process for winding electrical conductor material according to aspects of the present disclosure. In some examples, these operations are performed by a system including a processor executing a set of codes to control functional elements of an apparatus. Additionally or alternatively, certain processes are performed using special-purpose hardware. Generally, these operations are performed according to the methods and processes described in accordance with aspects of the present disclosure. In some cases, the operations described herein are composed of various substeps, or are performed in conjunction with other operations.

At operation 900, a vehicle engages with a bobbin to automatically orient the vehicle with respect to the looped winding trough while the vehicle is traversing a stationary bobbin. In some cases, the operations of this step refer to, or may be performed by, a vehicle as described with reference to FIGS. 4-7.

At operation 905, the vehicle traverses the stationary bobbin, where the bobbin includes a continuous looped winding trough configured to receive the electrical conductor material. In some cases, the operations of this step refer to, or may be performed by, a vehicle as described with reference to FIGS. 4-7.

At operation 910, the vehicle dispenses the electrical conductor material continuously into the looped winding trough while the vehicle is traversing the stationary bobbin, where a set of coils of the electrical conductor material are placed in the winding trough. In some cases, the operations of this step refer to, or may be performed by, a vehicle as described with reference to FIGS. 4-7.

Figure 10:
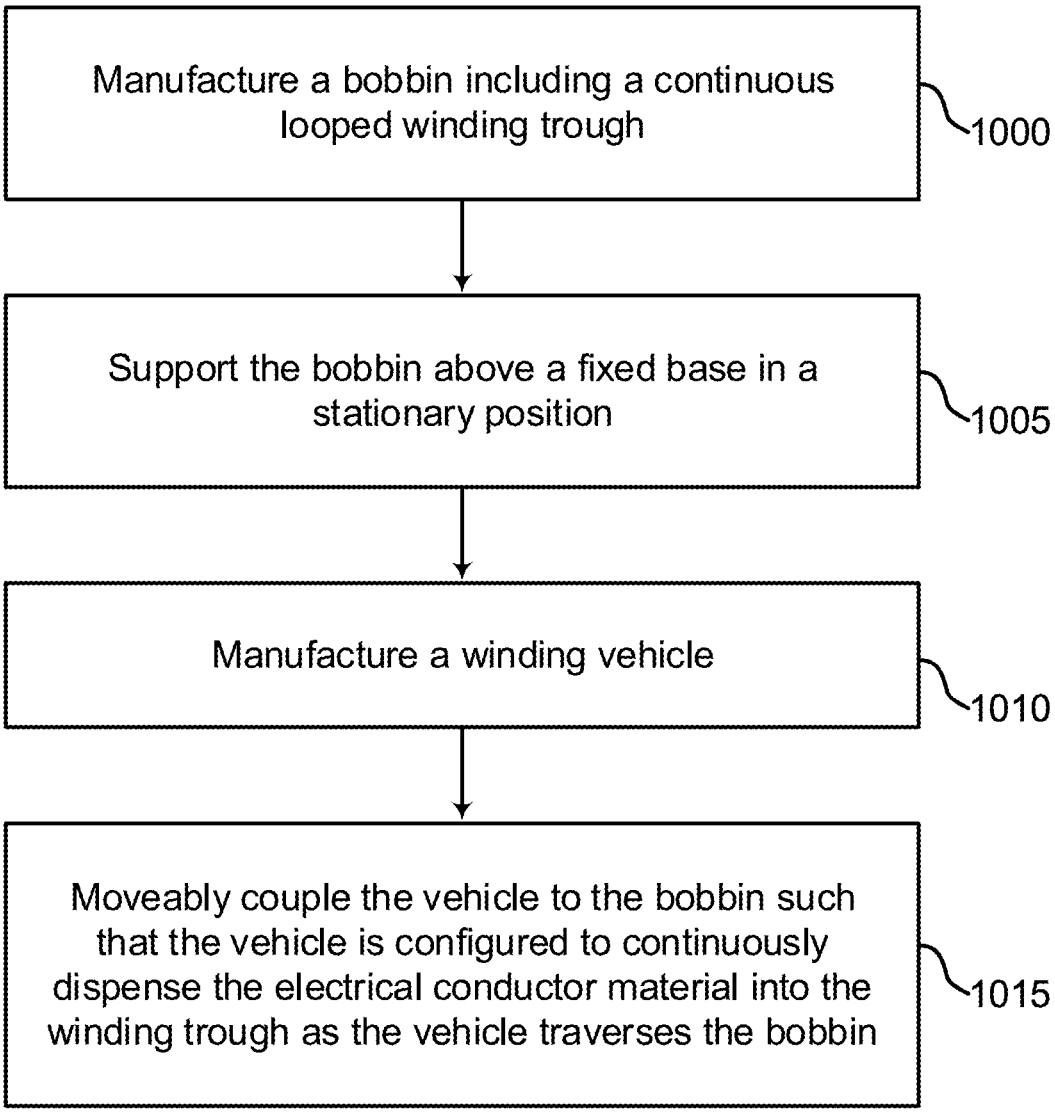
FIG. 10 shows an example of a process for manufacturing a system for winding electrical conductor material according to aspects of the present disclosure.

FIG. 10 shows an example of a process for manufacturing a system for winding electrical conductor material according to aspects of the present disclosure. In some examples, these operations are performed by a system including a processor executing a set of codes to control functional elements of an apparatus. Additionally or alternatively, certain processes are performed using special-purpose hardware. Generally, these operations are performed according to the methods and processes described in accordance with aspects of the present disclosure. In some cases, the operations described herein are composed of various substeps, or are performed in conjunction with other operations.

At operation 1000, the system manufactures a bobbin including a continuous looped winding trough.

At operation 1005, the system supports the bobbin above a fixed base in a stationary position.

At operation 1010, the system manufactures a winding vehicle, where the vehicle includes a frame and is configured to continuously dispense continuous electrical conductor material.

At operation 1015, the system moveably couples the vehicle to the bobbin such that the vehicle is configured to continuously dispense the electrical conductor material into the winding trough as the vehicle traverses the bobbin along the winding trough.

Accordingly, the present disclosure includes the following embodiments.

An apparatus for winding electrical conductor material is described. One or more embodiments of the apparatus include a stationary bobbin including a continuous looped winding trough and a vehicle including a frame and being movably coupled to the stationary bobbin, the vehicle being configured to traverse the bobbin and, while traversing the bobbin, continuously dispense continuous electrical conductor material into the continuous looped winding trough, where a plurality of coils of the electrical conductor material are placed in the winding trough.

A system for winding electrical conductor material, the system comprising: a stationary bobbin including a continuous looped winding trough and a vehicle including a frame and being movably coupled to the stationary bobbin, the vehicle being configured to traverse the bobbin and, while traversing the bobbin, continuously dispense continuous electrical conductor material into the continuous looped winding trough, where a plurality of coils of the electrical conductor material are placed in the winding trough.

A method of manufacturing an apparatus for winding electrical conductor material is described. The method includes manufacturing a stationary bobbin including a continuous looped winding trough and a vehicle including a frame and being movably coupled to the stationary bobbin, the vehicle being configured to traverse the bobbin and, while traversing the bobbin, continuously dispense continuous electrical conductor material into the continuous looped winding trough, where a plurality of coils of the electrical conductor material are placed in the winding trough.

A method of using an apparatus for winding electrical conductor material is described. The method includes a stationary bobbin including a continuous looped winding trough and a vehicle including a frame and being movably coupled to the stationary bobbin, the vehicle being configured to traverse the bobbin and, while traversing the bobbin, continuously dispense continuous electrical conductor material into the continuous looped winding trough, where a plurality of coils of the electrical conductor material are placed in the winding trough.

In some examples, the system is configured to automatically orient the vehicle with respect to the continuous looped winding trough while the vehicle traverses the bobbin. In some examples, the configuration to automatically orient the vehicle includes a continuous track in the bobbin and at least one self-referencing member of the vehicle engaged with the continuous track. In some examples, the vehicle further includes at least one articulating structure engaged with the bobbin to facilitate self-referencing of the vehicle.

In some examples, the vehicle is configured for self-propelling along the trough. In some examples, the self-propelling includes the vehicle using a drive motor coupled to the frame to rotate a plurality of wheels of the vehicle, where operation of the drive motor rolls the vehicle along the winding trough. In some examples, the vehicle is configured to store undispensed electrical conductor material and dispense the electrical conductor material. In some examples, the electrical conductor is stored on and dispensed by a rotating spool rotatably coupled to the vehicle.

In some examples, the vehicle is configured to receive the electrical conductor material from an off-vehicle location prior to dispensing the electrical conductor material. In some examples, the vehicle is configured to traverse the bobbin by being manually propelled along the winding trough. In some examples, the bobbin comprises copper, steel, aluminum, or any mixture thereof. In some examples, the bobbin is formed by additive manufacturing. In some examples, the bobbin comprises a shape that is formed at least in part by additive manufacturing. In some examples, the bobbin comprises a shape formed at least in part by machining.

In some examples, the final assembly of the system includes usage of electrical solder material. In some examples, the electrical conductor material is high-temperature superconducting tape material or high-temperature superconducting wire material. In some examples, the electrical conductor material is low-temperature superconducting wire material. In some examples, the electrical conductor material is an assembly comprising a plurality of different electrical conductor materials. In some examples, one of the different electrical conductor materials is an electrically insulating material. In some examples, the winding trough is a double pancake winding trough.

A method for winding electrical conductor material is described. One or more embodiments of the method include traversing of a stationary bobbin by a vehicle, wherein the bobbin includes a continuous looped winding trough configured to receive the electrical conductor material and dispensing the electrical conductor material continuously from the vehicle into the looped winding trough while the vehicle is traversing the stationary bobbin, where a plurality of coils of the electrical conductor material are placed in the winding trough.

An apparatus for winding electrical conductor material is described. The apparatus includes a processor, memory in electronic communication with the processor, and instructions stored in the memory. The instructions are operable to cause the processor to perform the steps of traversing of a stationary bobbin by a vehicle, wherein the bobbin includes a continuous looped winding trough configured to receive the electrical conductor material and dispensing the electrical conductor material continuously from the vehicle into the looped winding trough while the vehicle is traversing the stationary bobbin, where a plurality of coils of the electrical conductor material are placed in the winding trough.

Some examples of the method, apparatus, non-transitory computer readable medium, and system described above further include engaging with the bobbin, by the vehicle, to automatically orient the vehicle with respect to the looped winding trough while the vehicle is traversing the stationary bobbin. In some examples, the vehicle engaging with the bobbin comprises a continuous track in the bobbin and a self-referencing member of the vehicle engaged with the continuous track. In some examples, the vehicle includes at least one articulating structure engaged with the bobbin to facilitate self-referencing of the vehicle.

Some examples of the method, apparatus, non-transitory computer readable medium, and system described above further include forming an electromagnetic coil with the plurality of coils as a result of the electromagnetic conductor material placed in the trough. In some examples, the vehicle traversing the bobbin comprises the vehicle being self-propelled along the bobbin. In some examples, the self-propelling of the vehicle comprises a drive motor of the vehicle operating a plurality of wheels of the vehicle, where operation of the drive motor rolls the vehicle along the trough. In some examples, the vehicle is configured to store undispensed electrical conductor material. In some examples, the vehicle is configured to store undispensed electrical conductor material.

In some examples, the undispensed electrical conductor material is stored on a rotating spool movably coupled to the vehicle. In some examples, the electrical conductor material is received from an off-vehicle location prior to the dispensing. In some examples, the traversing of the bobbin by the vehicle comprises the vehicle being manually propelled along the bobbin. In some examples, the electrical conductor material is high-temperature superconducting tape material or high-temperature superconducting wire material. In some examples, the electrical conductor material is low-temperature superconducting wire material. In some examples, the electrical conductor material is an assembly comprising a plurality of different electrical conductor materials. In some examples, one of the different electrical conductor materials is an electrically insulating material. In some examples, the winding trough is a double pancake winding trough.

A method for manufacturing a system for winding electrical conductor material is described. One or more embodiments of the method include manufacturing a bobbin including a continuous looped winding trough, supporting the bobbin above a fixed base in a stationary position, manufacturing a winding vehicle, wherein the vehicle includes a frame and is configured to continuously dispense continuous electrical conductor material, and movably coupling the vehicle to the bobbin such that the vehicle is configured to continuously dispense the electrical conductor material into the winding trough as the vehicle traverses the bobbin along the winding trough.

While the invention herein disclosed has been described by means of specific embodiments, examples and applications thereof, numerous modifications and variations could be made thereto by those skilled in the art without departing from the scope of the invention set forth in the claims.

What is claimed is:

1. A system for winding electrical conductor material, comprising:

a stationary bobbin including a continuous looped winding trough;

a vehicle including a frame and being movably coupled to the stationary bobbin and configured to:

traverse the bobbin; and while traversing the bobbin, continuously dispense continuous electrical conductor material into the continuous looped winding trough, whereby a plurality of coils of the electrical conductor material are placed in the winding trough.

2. The system for winding electrical conductor material of claim 1, the system further configured to automatically orient the vehicle with respect to the continuous looped winding trough while the vehicle traverses the bobbin.

3. The system for winding electrical conductor material of claim 2, wherein the configuration to automatically orient the vehicle includes a continuous track in the bobbin and at least one self-referencing member of the vehicle engaged with the continuous track.

4. The system for winding electrical conductor material of claim 2, the vehicle further comprising at least one articulating structure engaged with the bobbin to facilitate self-referencing of the vehicle.

5. The system for winding electrical conductor material of claim 1, the vehicle further configured for self-propelling along the trough.

6. The system for winding electrical conductor material of claim 5, the configuration for self-propelling comprising the vehicle including a drive motor coupled to the frame and configured to rotate a plurality of wheels of the vehicle, whereby operation of the drive motor rolls the vehicle along the winding trough.

7. The system for winding electrical conductor material of claim 1, the vehicle further configured to store undispensed electrical conductor material and dispense the electrical conductor material.

8. The system for winding electrical conductor material of claim 7, wherein the electrical conductor material is stored on and dispensed by a rotating spool rotatably coupled to the vehicle.

9. The system for winding electrical conductor material of claim 1, the vehicle further configured to receive the electrical conductor material from an off-vehicle location prior to dispensing the electrical conductor material.

10. The system for winding electrical conductor material of claim 1, wherein the vehicle is configured to traverse the bobbin by being manually propelled along the winding trough.

11. The system for winding electrical conductor material of claim 1, wherein the bobbin further comprises copper, steel, aluminum, or any mixture thereof.

12. The system for winding electrical conductor material of claim 1, wherein a shape of the bobbin is formed at least in part by one of additive manufacturing and machining.

13. The system for winding electrical conductor material of claim 1, wherein electrical solder material is used in a final assembly of the system.

14. The system for winding electrical conductor material of claim 1, wherein the electrical conductor material is high-temperature superconducting tape material or high-temperature superconducting wire material.

15. The system for winding electrical conductor material of claim 1, wherein the electrical conductor material is low-temperature superconducting wire material.

16. The system for winding electrical conductor material of claim 1, wherein the electrical conductor material is an assembly comprising a plurality of different electrical conductor materials.

17. The system for winding electrical conductor material of claim 16, wherein one of the different electrical conductor materials is an electrically insulating material.

18. The system for winding electrical conductor material of claim 1, wherein the winding trough is a double pancake winding trough.

19. A method for winding electrical conductor material, comprising:

traversing of a stationary bobbin by a vehicle, wherein the bobbin includes a continuous looped winding trough configured to receive the electrical conductor material; and while the vehicle is traversing the stationary bobbin, continuously dispensing the electrical conductor material from the vehicle into the looped winding trough, whereby a plurality of coils of the electrical conductor material are placed in the winding trough.

20. The method for winding electrical conductor material of claim 19, further comprising the step of, while the vehicle is traversing the stationary bobbin, the vehicle engaging with the bobbin to automatically orient the vehicle with respect to the looped winding trough.

21. The method for winding electrical conductor material of claim 20, wherein the vehicle engaging with the bobbin comprises a continuous track in the bobbin and a self-referencing member of the vehicle engaged with the continuous track.

22. The method for winding electrical conductor material of claim 20, the vehicle further comprising at least one articulating structure engaged with the bobbin to facilitate self-referencing of the vehicle.

23. The method for winding electrical conductor material of claim 19, further comprising the step of forming an electromagnetic coil with the plurality of coils as a result of the electromagnetic conductor material placed in the trough.

24. The method for winding electrical conductor material of claim 19, wherein the vehicle traversing the bobbin comprises the vehicle being self-propelled along the bobbin.

25. The method for winding electrical conductor material of claim 19, wherein the self-propelling of the vehicle comprises a drive motor of the vehicle operating a plurality of wheels of the vehicle, whereby operation of the drive motor rolls the vehicle along the trough.

26. The method for winding electrical conductor material of claim 19, wherein the vehicle is configured to store undispensed electrical conductor material.

27. The method for winding electrical conductor material of claim 26, wherein the undispensed electrical conductor material is stored on a rotating spool movably coupled to the vehicle.

28. The method for winding electrical conductor material of claim 19, wherein, prior to dispensing, the electrical conductor material is received from an off-vehicle location.

29. The method for winding electrical conductor material of claim 19, wherein the traversing of the bobbin by the vehicle comprises the vehicle being manually propelled along the bobbin.

30. The method for winding electrical conductor material of claim 19, wherein the electrical conductor material is high-temperature superconducting tape material or high-temperature superconducting wire material.

31. The method for winding electrical conductor material of claim 19, wherein the electrical conductor material is low-temperature superconducting wire material.

32. The method for winding electrical conductor material of claim 19, wherein the electrical conductor material is an assembly comprising a plurality of different electrical conductor materials.

33. The method for winding electrical conductor material of claim 32, wherein one of the different electrical conductor materials is an electrically insulating material.

34. The method for winding electrical conductor material of claim 19, wherein the winding trough is a double pancake winding trough.

35. A method for manufacturing a system for winding electrical conductor material, comprising:

manufacturing a bobbin including a continuous looped winding trough;

supporting the bobbin above a fixed base in a stationary position;

manufacturing a winding vehicle, wherein the vehicle includes a frame and is configured to continuously dispense continuous electrical conductor material;

movably coupling the vehicle to the bobbin such that the vehicle is configured to continuously dispense the electrical conductor material into the winding trough as the vehicle traverses the bobbin along the winding trough.

* * * * *